US005772029A

United States Patent [19]

Boccacci

[11] Patent Number: 5,772,029

[45] Date of Patent: Jun. 30, 1998

[54] FOLDABLE DOCUMENT FILE WITH AN ADJUSTABLE VOLUME

[76] Inventor: Roberto Boccacci, Via Panfeo, 41, 00125 Rome, Italy

[21] Appl. No.: 624,534

[22] PCT Filed: Oct. 12, 1994

[86] PCT No.: PCT/IT94/00169

§ 371 Date: Jul. 11, 1996

§ 102(e) Date: Jul. 11, 1996

[87] PCT Pub. No.: WO95/10422

PCT Pub. Date: Apr. 20, 1995

[30] Foreign Application Priority Data

Oct. 15, 1993 [IT] Italy ..... RM93A0694

[51] Int. Cl.[6] ..... B65D 5/355

[52] U.S. Cl. ..... 206/425; 220/8; 229/23 BT; 312/205

[58] Field of Search ..... 206/425, 449, 206/459.1, 459.5; 190/105; 220/8; 229/23 BT; 312/205

[56] References Cited

U.S. PATENT DOCUMENTS

| | | | |
|---|---|---|---|
| 567,026 | 9/1896 | Goldberg | 190/105 |
| 664,043 | 12/1900 | Holman et al. | 190/105 |
| 968,633 | 8/1910 | Andrews | 220/8 |
| 1,407,688 | 2/1922 | Banton | 229/120 |
| 2,176,284 | 10/1939 | Whiteford | 206/425 |
| 3,521,810 | 7/1970 | Boyer | 229/23 BT |
| 3,926,362 | 12/1975 | Beck et al. | 229/23 BT |
| 4,787,488 | 11/1988 | Campanini | 220/8 |
| 5,016,753 | 5/1991 | Henderson | 206/459.1 |

FOREIGN PATENT DOCUMENTS

| | | |
|---|---|---|
| 0 099 170 | 1/1984 | European Pat. Off. . |
| 625 369 | 8/1927 | France . |
| 23 44 874 | 3/1975 | Germany . |
| 543 973 | 12/1973 | Switzerland . |

*Primary Examiner*—Jimmy G. Foster
*Attorney, Agent, or Firm*—Finnegan, Henderson, Farabow, Garrett & Dunner, L.L.P.

[57] ABSTRACT

A foldable document file box with an adjustable volume which can be folded in a flat configuration for easier storage, having two half shells joined by releasable closure elements to permit adjustment of the volume defined by the half shells. The half shells are connected so that they can be placed in a flat configuration while remaining connected. Detent elements are provided to adjust the volume of the document file box in a stepped manner.

11 Claims, 3 Drawing Sheets

FOLDABLE DOCUMENT FILE WITH AN ADJUSTABLE VOLUME

BACKGROUND OF THE INVENTION

The present invention relates to a document file, in particular for archiving purposes, which can be folded flat and has an adjustable volume.

Document files of various forms are already known from the state of the art, including those having a parallelepipedal shape with one side and one end which can be opened like a folder and which can contain loose documents or folders of documents.

These files of the known art, which are usually made of plastic or stout cardboard, basically have two main drawbacks:

- a large volume when they are empty and being stored either during production or distribution or by the final user;
- the need to have various types of files with different volumes and consequently the need to have several stock items both in production and distribution, or at the customer's premises, resulting in increased costs and complex management of supplies, since it is impossible to predict which size of file will best suit customer requirements CH 543 973 discloses a document file with an adjustable volume constituted of two rigid half shell elements that can be coupled together with a dove-tail arrangement in order to define the document collection space.

The structure shown in this document is not collapsible to a flat form obtaining a minimum storage space before or after the use.

EP-A-0 099 170 discloses a magazine holder constituted of a single sheet of plastic material that by folding flanges and coupling slots into locking interrelationship can be made to assume a tridimensional structure when erected for storing magazines and the like.

The structure provided by this document provides a fixed space for receiving magazines or documents that cannot be adjusted either before a during the use to adapt it to a variable quantity of magazines or documents to be contained.

SUMMARY OF THE INVENTION

The object of the present invention is to provide an improved structure of elements for the production of files of the type mentioned above which enables the drawbacks listed above to be overcome.

According to the present invention the document file, which has an adjustable volume and comprises a pair of containing elements forming an internal component and an external component with complementary engagement elements that can be coupled together is characterized in that it can be folded flat and comprises a pair of initially flat elements, separated from each other, designed to make up an internal component and an external component of the file; said elements having respective flaps which, once they have been folded at right angles, form a first internal half-shell and a second external half-shell, which can be inserted one inside the other to form a box-like containing structure which can be closed on itself; the flaps which are provided on at least three sides of the internal and external components, having complementary engagement elements positioned so as to adjust the connection of the flaps, for a stepped or similar manner, in order to define correspondingly adjustable volumes of the file in its assembled and ready-to-use state.

In order to be able to fold the file flat, so that it can be packed, stored and transported easily and conveniently, the flaps forming the side opposite the opening can be opened and include releaseable closure elements. Furthermore, the external half-shell is fitted with identification accessories.

Preferably, according to the present invention, the male and female half-shells are made from a thermoplastic material with oriented macromolecules, so as to be able to produce a set of integral hinges at the points where the two half-shells are folded during assembly of the file. However, cardboard provided with suitable crease lines corresponding to the lines of folding may also be used.

Again according to the present invention, the two half-shells are preferably provided with microperforations in order to enable air to circulate inside the file, thereby providing improved storage conditions for the papers contained therein.

Other objects and advantages of the present invention will become clear from the detailed description which follows which is given with reference to a preferred embodiment of the invention described by way of illustrative and nonlimiting example and based on the figures shown in the appended drawings in which:

DETAILED DESCRIPTION OF INVENTION

Figure 1:
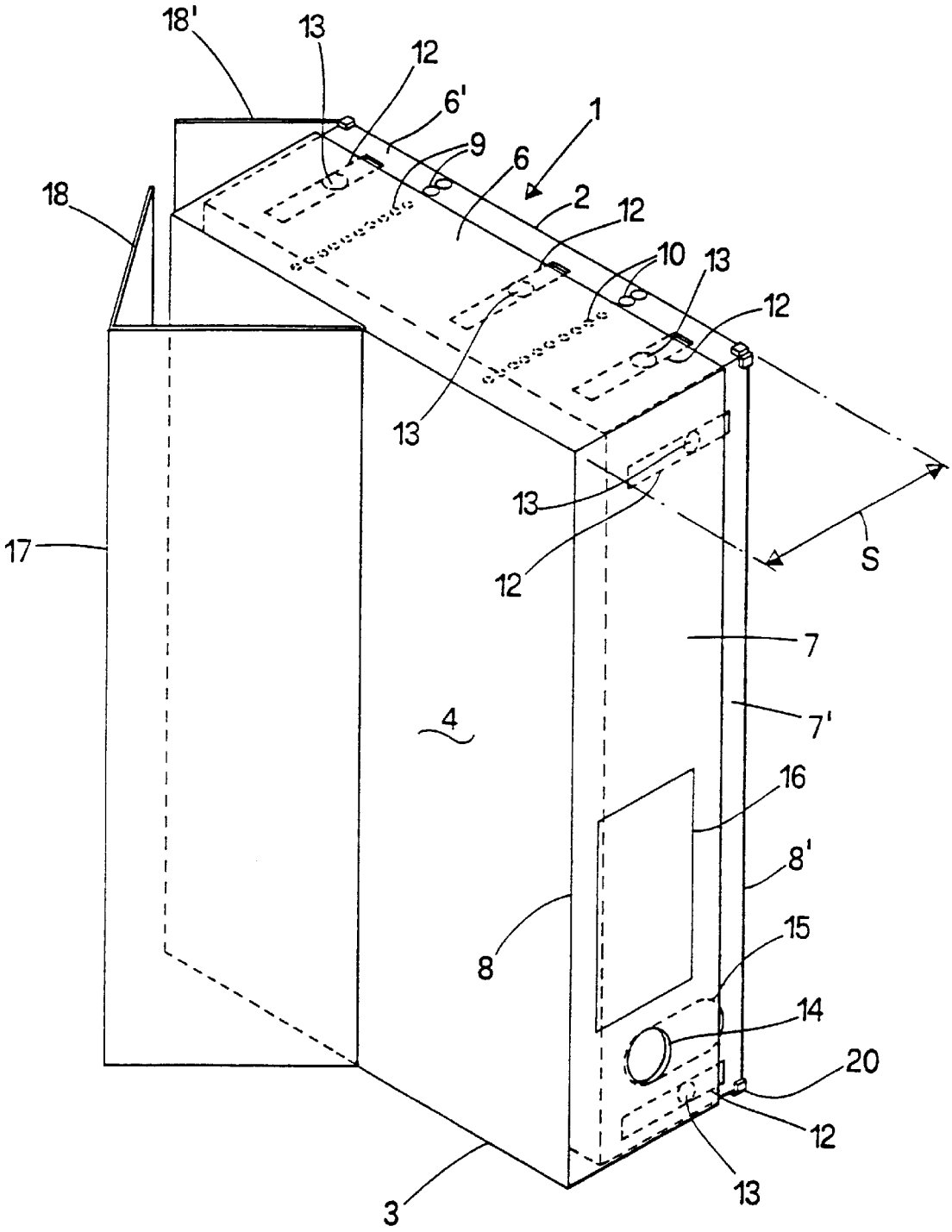
FIG. 1 is a perspective view showing the file according to the present invention in its assembled state.
Figure 2:
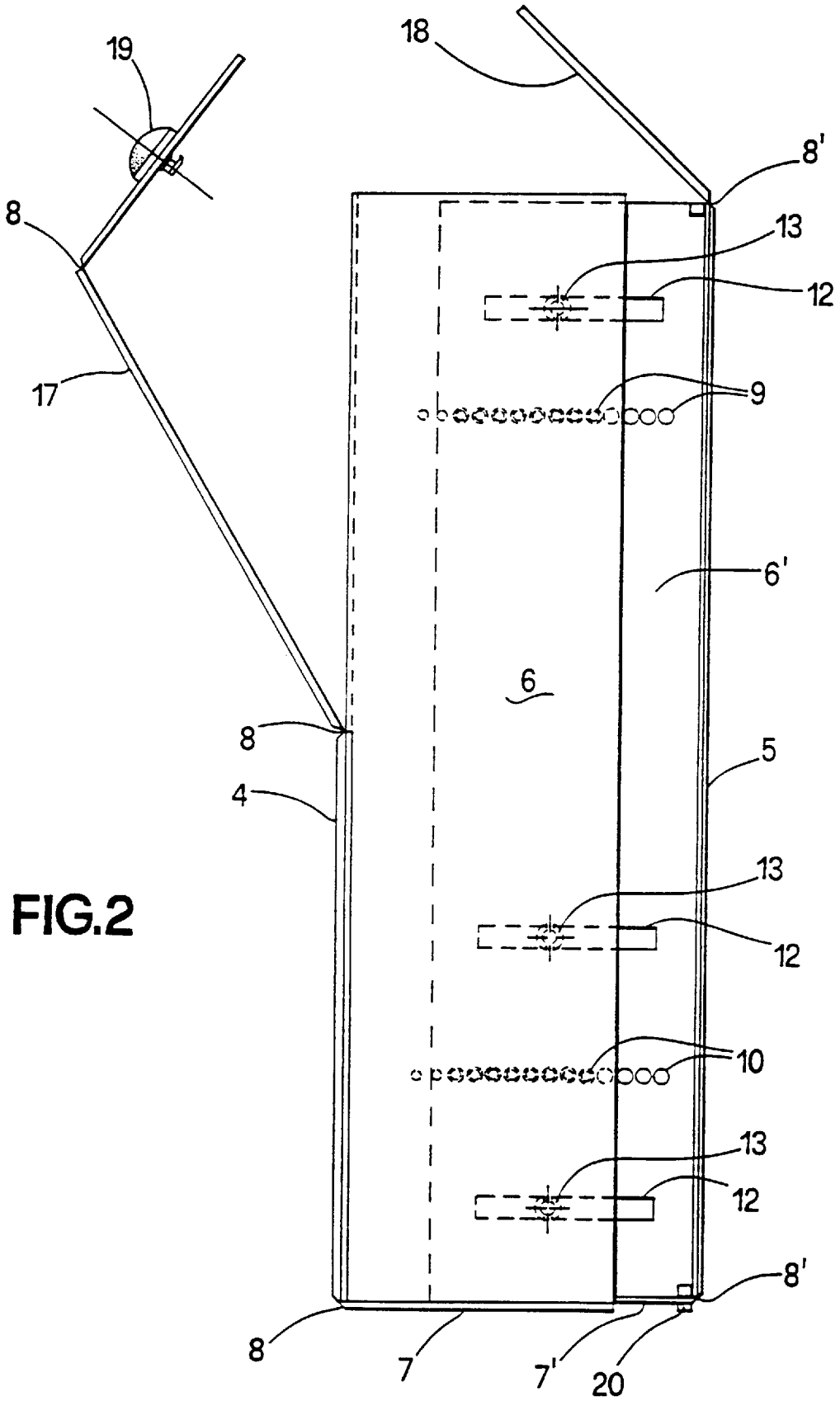
FIG. 2 is a slide elevation view showing the file of FIG. 1 in plan view.

With reference to the figures, the file 1 comprises an internal component 2 and external component 3 formed from two flat elements which are separated from each other. The components 2 and 3 comprise a central body 4 and 5, with reference to the internal component 2 and to the external component 3 respectively, and have flaps 6–6' at the top and bottom and flaps 7–7' at the rear which are joined to three sides, of the central body 4—5 by means of integral hinges, indicated diagrammatically by 8–8' and obtained during the moulding stage of the internal and external component during its production.

These integral hinges 8–8' are well known and can be produced when using plastic materials having oriented macromolecules such as polypropylene, for example MOPLEN by Montedison.

Advantageously, for embodiments of this type recycled and recyclable polypropylene can be used, resulting in considerable advantages from the point of view of reducing the costs of supplying materials.

The flaps 6–6' and 7–7' of the file 1, including the corresponding flaps which are not visible in FIG. 1, are provided with a series of projections and corresponding recesses, indicated as a whole by 9 and 10, of complementary shape, so that when they engage inside one another they can define varying thicknesses S of the file in order to form different sizes of file during use of the structure, thereby enabling stocks and archive space to be optimized.

The flaps 6' and 7' are also provided with slots 12 positioned so as to engage with fastening elements 13 such as small expandable and releasable fasteners shaped like a nail, or similar connection means, which holds the external flaps 6 and 7 in position with respect to the internal flaps 6' and 7'.

Clearly, the same structure is duplicated for those parts which are not visible in the figure.

Figure 4:
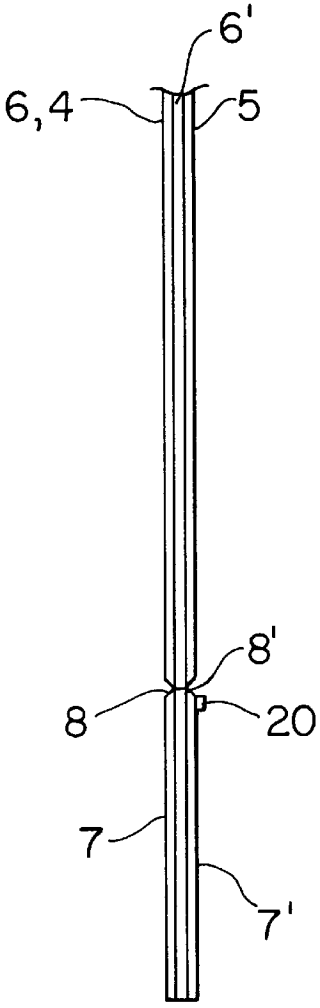
FIG. 4 is a partial side elevation view showing the file box of FIG. 3 folded in a flat configuration.
Figure 3:
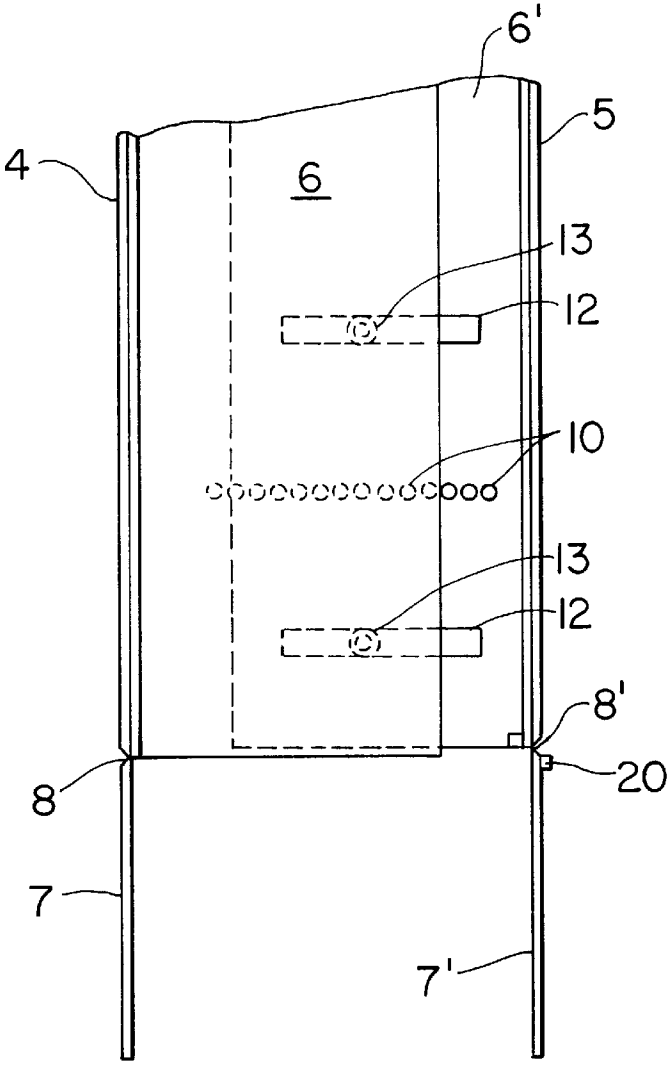
FIG. 3 is a partial side elevation view showing the file box of FIG. 2 with the flaps of the bottom face in an open configuration.

Referring to FIG. 3, the file box is shown with flaps 7 and 7', opposite to the opening, in an open configuration. Referring to FIG. 4, the file box is shown in the flat configuration, with flaps 7 and 7' open.

The back and/or one side of the file have, on the external flap 6 and/or 7, a finger hole 14 which is line with a corresponding slot 15 formed in the internal flap 6' and/or 7'.

One or more pockets 16 are also provided and are designed to hold an identification card of conventional type.

In order to be able to carry it easily, a removable handle (not shown in the figure) may be attached to the file once it has been assembled.

The internal component 2 and the external component 3 are fitted with opening flaps 17–18 and 18' in order to allow access inside the said file. The opening flap 18 is furthermore provided with one or more reversible closure elements 19.

Small feet, indicated diagrammatically at 20, may also be provided on the internal component 2 in order to give the file greater stability when it is stacked or placed on shelves or the like.

Preferably, the walls of the file are of an air permeable material, in other words the walls are provided with microholes in order to allow at least some air to circulate so as to allow the papers contained therein to "breathe", thereby preventing them from deteriorating.

I claim:

1. A document storage box having an adjustable volume, comprising:

a first sheet component and a second sheet component, each sheet component including:

a central panel having a pair of spaced parallel edges and at least one connecting edge extending between the parallel edges; and a flap hinged to each of the parallel and connecting edges of the central panel, so that each sheet component can be oriented in a flat configuration, and so that each flap of the first sheet component and of the second sheet component can be folded relative to the respective central panel, to form respectively a first half shell and a second half shell, the flaps of the first half shell overlapping to corresponding flaps of the second half shell to provide an adjustable enclosed volume;

slidable elements disposed on the overlapping flaps hinged to the parallel edges and releasable slidable closure elements disposed on the overlapping flaps hinged to the connecting edges, for adjustably fastening the half shells to each other, and for allowing said half shells to be oriented in a flat configuration while connected by the slidable elements disposed on the flaps of the parallel edges, so that the document storage box can be placed in a flat configuration; and complementary detents disposed on the overlapping flaps of the box, the detents having complementary projections and recesses disposed on the respective corresponding flaps, for maintaining the enclosed volume to which the first and second half shells are adjusted.

2. The document storage box of claim 1, wherein identification means are fastened to one of the half shells.

3. The document storage box of claim 1, wherein the first and second sheet components are made of an air permeable material, enabling air to circulate inside the box.

4. The document storage box of claim 1, wherein the central panel of the second sheet component has an opening hinge parallel to a top face of the box, defining a portion of said central panel between the opening hinge and the top face which is detached from the two side flaps of the second sheet component, so that said portion of the central panel can be folded to form a large opening of the document storage box.

5. The document storage box of claim 1, wherein the slidable elements include slots on a first set of flaps and fastening elements on a second set of flaps overlapping the first set of flaps.

6. The document storage box of claim 1, wherein the complementary detents are placed at a plurality of locations on at least three pairs of overlapping flaps of the box.

7. The document storage box of claim 1, wherein small support extensions protrude at the corners of the flaps near the edges of the central panel of one of the sheet components.

8. The document storage box of claim 1, wherein the first and second sheet components are made from a thermoplastic material.

9. A document storage box having an adjustable volume, comprising:

a first sheet component and a second sheet component, each sheet component including a rectangular central panel having four adjacent edges and a flap connected to each edge of the central panel by an integral hinge, so that each sheet component can be oriented in a flat configuration, and so that each flap of the first sheet component and of the second sheet component can be folded at right angles to the respective central panel, to form respectively a first half shell and a second half shell, said first half shell being insertable into said second half shell to provide an adjustable enclosed volume, and to provide a top, a bottom, and two side faces of the box, defined by complementing folded flaps;

complementary detent engagement means disposed on the flaps of said side faces of the box, the detent engagement means having a plurality of projections protruding from one of the complementing flaps of the side faces, and a plurality of recesses disposed on the other complementary flaps of the side faces in facing contact with said projections, to adjust in a stepped manner the adjustable enclosed volume; and releasable closure elements disposed on said side, top and bottom faces to fasten together the complementing folded flaps of said faces, having slots on the flaps of said first half shell, and fastening elements on the flaps of said second half shell in facing contact with said slots, allowing said first and second half shells to be oriented in a flat configuration while remaining connected when the releasable closure elements disposed on the top face and bottom face are in the released configuration, so that the document storage box can be placed in a flat configuration, wherein the central panel of the second sheet component has an opening hinge parallel to the top face, defining a portion of the central panel of the second sheet between the opening hinge and the top face, the portion being detached from the two side flaps of the second sheet component, so that said portion of the central panel can be folded to form a large opening of the document storage box.

10. A document storage box having an adjustable volume, comprising:

a first sheet component and a second sheet component, each sheet component including:

a central panel having a pair of spaced parallel edges and at least one connecting edge extending between the parallel edges; and a flap hinged to each of the parallel edges and to at least one of the connecting edges of the central panel, so that each sheet component can be oriented in a flat configuration, and so that each flap of the first sheet component and of the second sheet component can be folded relative to the respective central panel, to form respectively a first half shell and a second half shell, the flaps of the first and second half shells overlapping to provide an adjustable enclosed volume; and slidable elements disposed on the overlapping flaps hinged to the parallel edges and releasable slidable closure elements disposed on the overlapping flaps hinged to the connecting edges, for adjustably fastening the half shells to each other, and for allowing said half shells to be oriented in a flat configuration while connected by the slidable elements disposed on the flaps of the parallel edges, so that the document storage box can be placed in a flat configuration.

11. The document storage box of claim 10, wherein the central panel of one of the first and second sheet components has an opening hinge originating adjacent to one parallel edge and terminating adjacent to the other parallel edge of the central panel, defining a portion of said central panel between the opening hinge and a top face of the box which is detached from the two flaps hinged to the parallel edges of the sheet component, so that said portion of the central panel can be folded to form a large opening of the document storage box.

* * * * *